US005313730A

United States Patent [19]

Tiller

[11] Patent Number: 5,313,730

[45] Date of Patent: May 24, 1994

[54] MAP HOLDER

[76] Inventor: Dale K. Tiller, P.O. Box 8180, Ottawa, Ontario K1G 3H7, Canada

[21] Appl. No.: 985,117

[22] Filed: Dec. 3, 1992

[51] Int. Cl.[5] ..... G09F 3/18

[52] U.S. Cl. ..... 40/642; 40/661; 40/904

[58] Field of Search ..... 40/642, 904, 661, 109

[56] References Cited

U.S. PATENT DOCUMENTS

| | | | |
|---|---|---|---|
| 2,722,068 | 11/1955 | Elsholz | 40/904 |
| 2,729,908 | 1/1956 | Miller | 40/904 |
| 2,787,070 | 4/1957 | Idoine | 40/904 |
| 3,328,899 | 7/1967 | Steward | 40/904 |
| 4,641,440 | 2/1987 | Agranov | 40/643 |

FOREIGN PATENT DOCUMENTS

| | | | |
|---|---|---|---|
| 2215111 | 9/1989 | United Kingdom | 40/904 |

*Primary Examiner*—Kenneth J. Dorner
*Assistant Examiner*—J. Silbermann
*Attorney, Agent, or Firm*—Marks & Clerk

[57] ABSTRACT

A portable map holder comprises a substantially rigid elongate sleeve member having an open end through which a folded map can be inserted. The sleeve has a top wall made of transparent material to expose a map inserted therein. A transparent cursor is mounted on the sleeve for slidable movement therealong over the transparent top wall. The cursor incorporates a lens for magnifying inscriptions on a map inserted in the sleeve and visible through the top wall.

7 Claims, 2 Drawing Sheets

MAP HOLDER

BACKGROUND OF THE INVENTION

1. Field of the Invention

This invention relates to a map holder, especially a map holder of the type suitable for carrying street maps and the like.

2. Description of the Prior Art

U.S. Pat. No. 4,641,440, discloses a map holder for an automotive vehicle comprising a transparent cover and a bottom plate between which a map can be sandwiched. A telescopic pointer is provided to permit the user to trace a proposed route with a non-permanent marker.

Such a device is not intended to hold foldable maps, such as street maps. Furthermore, a problem with street maps is that they are often printed in very fine print, making it hard to read them, particularly where little time is available, for example when navigating a strange city by automobile.

SUMMARY OF THE INVENTION

An object of the present invention is to alleviate the aforementioned problem.

According to the present invention there is provided a portable map holder comprising a substantially rigid elongate sleeve member having an open end through which a folded map can be inserted, said sleeve having a top wall made of transparent material to expose a map inserted therein, and a transparent cursor mounted on said sleeve for slidable movement therealong over said transparent top wall, said cursor incorporating a lens for magnifying inscriptions on a map inserted in said sleeve and visible through said top wall.

The map holder is preferably in the form of a shallow rectangular box along which the cursor slides. The cursor can be in the form of a bridge member having overhanging side walls with inturned lips engaging in grooves on the sides of the box.

The box can be made of visible transparent plastic material, such as Perspex. Preferably it is formed by injection molding.

In a still further preferred embodiment, the cursor is provided with a small lamp connected to a plug for insertion into the standard lighter socket of an automobile or to a battery incorporated in the unit.

The map holder of the invention is particularly useful for street maps. These often come in foldable format or small booklets, with the street names written in very fine print. The user can open the map to the appropriate page, slide it into the holder, and slide the cursor along the map to magnify the part in which he is interested. The holder is also particularly useful for an automobile driver at night since he can have the map beside him, with the cursor illuminated, and on stopping to find the way quickly read the relevant portions of the map. As he moves off the portion visible, he simply slides the folded map out of the holder, folds it to expose the desired portion of the map, and reinserts it into the holder.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
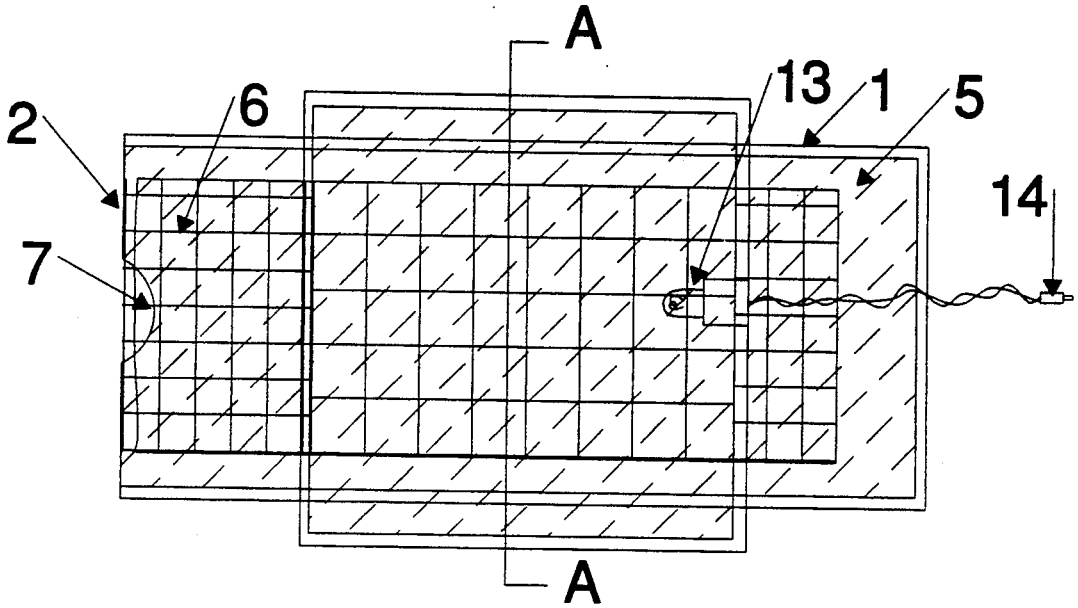
FIG. 1 is a plan view of a map holder in accordance with one embodiment of the invention.
Figure 2:
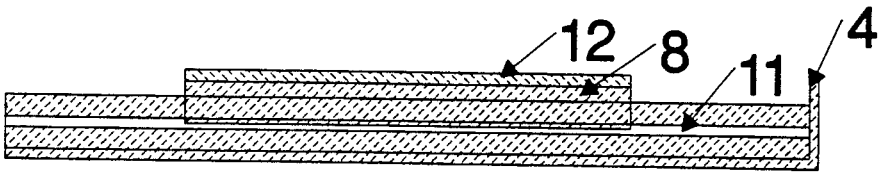
FIG. 2 is a side elevation of the map holder shown in FIG. 1.
Figure 3:
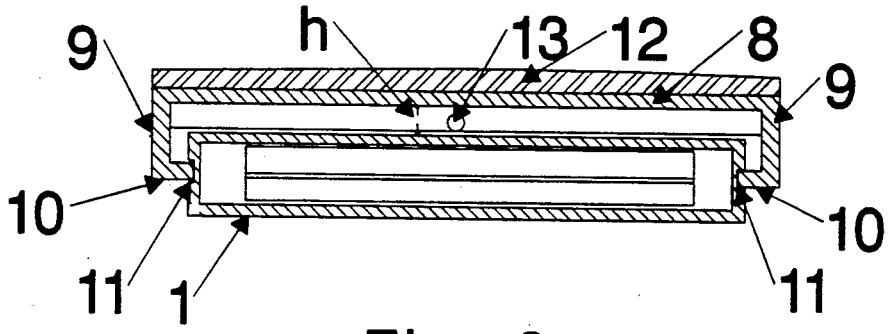
FIG. 3 is a cross-section taken along the line AA of FIG. 1.
Figure 4:
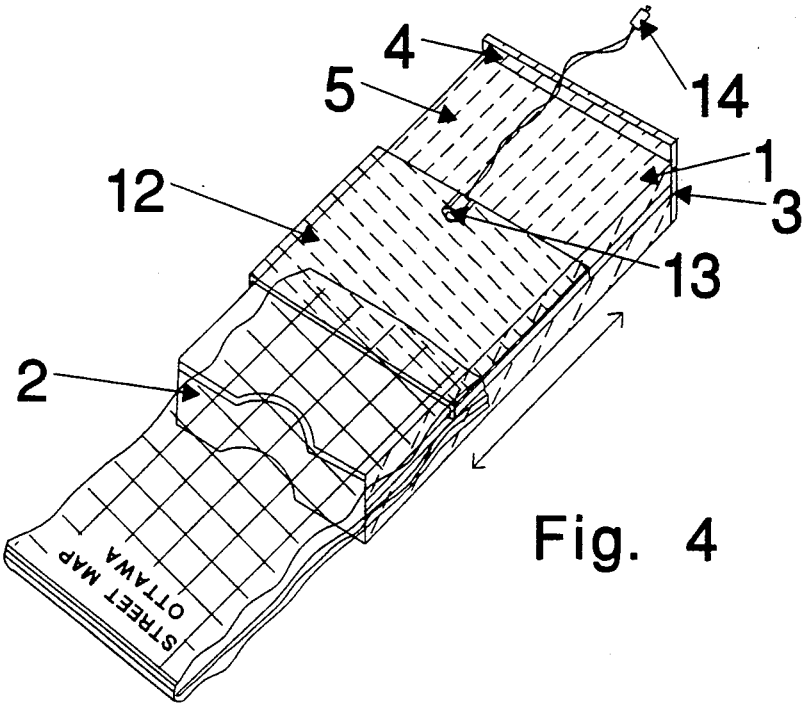
FIG. 4 is a perspective view of the map holder with the map partially inserted.

Referring now to the figures, the map holder comprises a shallow rectangular box 1 made of Perspex TM or similar transparent plastic material, which is open at one end 2 and closed at the other end 3, and having dimensions about 10"×6"×2". The closed end 3 forms a raised shoulder 4 extending above the transparent top wall 5 of the box 1. A folded map 6, which can be a foldable or booklet form street map, for example, slides into the box 1 through its open end 2. The map 6 is visible through the transparent top wall 5 of the box 1.

An arcuate recess 7 is formed at the open end 2 so as to permit the user to easily grasp the map 6 for withdrawal from the box 1.

A bridge-like cursor member 8 straddles the top of the box 1. The cursor member 8 has depending side walls 9 with lower inturned lips 10. The lips 10 engage in channel grooves 11 in the side walls of the box 1 to permit the cursor 8 to slide along the top surface of the box in the direction of the arrows. The cursor 8 has its major surface spaced a distance h above the top wall 5 of the box 1. A magnifying lens 12, which may be a Fresnel lens, is affixed to the top of the cursor 8, for example by means of a transparent adhesive. The distance h and the magnifying power of the lens 12 are such that a desired degree of magnification is provided for inscriptions on the map in the box 1. The magnifying power need not be substantial. Sheet like plastic Fresnel lenses are commercially available.

A small 12-Volt lamp 13 is mounted on the rear wall of the cursor 8. Lamp 13 is connected to a plug 14 adapted for insertion into the standard lighter socket of an automobile. Alternatively, the lamp can be powered from a small portable battery.

In use, the user takes the street map 6, and after folding it to expose the desired page, inserts it through the open end of the box 1 into the position shown in FIG. 1. If necessary, the plug 14 can be plugged into the lighter socket of an automobile to illuminate the lamp 13. The user can view the map, suitably magnified, through the transparent cursor 8, which of course can be slid up and down the box 1 so as to lie over the appropriate part of the map. Shoulder 4 prevents the cursor from sliding off the rear end of the box.

When the user moves off the page, he merely has to grasp the map 6 in the recess 7, remove it from the box, turn the page or refold the map and re-insert it into the box. This operation takes very little time. The bx is designed to be shallow so that in the case of a booklet, for example, it prevents the pages for turning while the booklet is in the box, and thereby keeps the desired page exposed.

The invention is primarily useful with street maps and the like, but it can be used for any map with fine print.

Although described as a separate element, the magnifying glass 12 can be molded integrally with the cursor 8.

I claim:

1. A portable map holder comprising a substantially rigid elongate sleeve in the form of a shallow rectangular box having an open end through which a folded map can be inserted, said sleeve having side walls and a top wall made of transparent material to expose a map inserted therein, and a transparent cursor mounted on said sleeve for slidable movement therealong over said transparent top wall, said cursor incorporating a lens for magnifying inscriptions on a map inserted in said sleeve and visible through said top wall.

2. A portable map holder as claimed in claim 1, wherein longitudinal grooves are provided in said side walls, and said cursor comprises a bridge-member having overhanging sidewalls with inturned lugs engaging respective said longitudinal grooves so that said cursor can slide along said sleeve.

3. A portable map holder as claimed in claim 2, wherein said lens comprises a sheet forming a Fresnel lens mounted to said bridge member.

4. A portable map holder as claimed in claim 2, wherein said bridge-member is transparent and has said lens integrally formed therein.

5. A portable map holder as claimed in claim 1, further comprising a lamp mounted on said cursor to illuminate a portion of the map viewable through the lens.

6. A portable map holder as claimed in claim 5, wherein said lamp is connected to a plug for insertion into an automotive cigarette lighter socket.

7. A portable map holder as claimed in claim 1, further comprising an upstanding shoulder on said sleeve for limiting the movement of said cursor at a distal end of said sleeve relative to said open end.

* * * * *